US005129525A

United States Patent [19]

Maynard, Jr.

[11] Patent Number: 5,129,525

[45] Date of Patent: Jul. 14, 1992

[54] STAND FOR READING MATERIAL AND PHONE

[76] Inventor: Stuart Tyrus Maynard, Jr., 12 Lookout Rd., Asheville, N.C. 28805

[21] Appl. No.: 548,280

[22] Filed: Jul. 3, 1990

[51] Int. Cl.[5] ..... A47F 3/14

[52] U.S. Cl. ..... 211/133; 211/26; 211/42

[58] Field of Search ..... 211/133, 187, 205, 193, 211/208, 26, 42; 108/108, 32, 96

[56] References Cited

U.S. PATENT DOCUMENTS

| | | | |
|---|---|---|---|
| 1,153,371 | 9/1915 | Carter | 211/187 X |
| 1,554,137 | 9/1925 | Slifkin | 211/187 X |
| 2,675,924 | 4/1954 | Jegen | 108/96 |
| 3,698,566 | 10/1972 | D'Altrui | 211/193 |
| 3,908,832 | 9/1975 | Marshall | 211/133 |
| 4,262,439 | 4/1981 | Dinan et al. | 40/607 |
| 4,531,642 | 7/1985 | Racich | 211/42 |

FOREIGN PATENT DOCUMENTS

| | | | |
|---|---|---|---|
| 452828 | 5/1968 | Switzerland | 108/108 |
| 731776 | 6/1955 | United Kingdom | 211/147 |

*Primary Examiner*—Blair M. Johnson

[57] ABSTRACT

A stand for printed materials and objects such as a phone having a single channel column and multiple slots for the attachment of multiple shelf-trays in selectable positions. The small footprint stand has a top with a handhold in the center of balance of the stand. In the channel space of the column, vertical slots allow for moveable placement of pocket containers and also a retractable panel which may pop up through the top of the stand. A slimline phone and small articles may be mounted in the channel space while printed materials reside on the shelf-trays.

11 Claims, 4 Drawing Sheets

STAND FOR READING MATERIAL AND PHONE

BACKGROUND

1. Field of the Invention

This invention relates to a stand to carry printed material such as magazines or books and phonebooks, as well as a telephone. The stand provides multiple shelves upon a single column support to allow for a small footprint and convenient placement next to other furniture such as a chair, sofa, or workdesk.

2. Description of Prior Art

In providing multiple surfaces for the placement of objects and a free standing structure that does not intrude greatly into floorspace, display stands are known with shelf-like structure supported on a single column. Such "display stands" must make items visible and accessible, and the stand must be moveable. Dinan (U.S. Pat. No. 4,262,439) discloses a system of shelves with central openings such that each may be slid over a post to the point of impinging on adjustable stops which provide wedging surfaces. Marshall (U.S. Pat. No. 3,908,832) shows a display stand for periodicals with a square post that carries multiple trays which have flanges that fit against opposed sides of the post. The flanges are held to the post by screws.

OBJECTS, ADVANTAGES, AND SUMMARY OF THE INVENTION

The invention is intended to provide multiple shelves which may be removed and adjusted to differing spacings on a single column support. To accomplish this, slots are cut into opposed surfaces of a column and a rigid and generally thin shelf piece is provided with a cutout at the center region of one of its edges. This cutout allows for each shelf to be moved to a selected pair of slots with a single motion. Once inserted into a pair of slots, the slots provide each shelf with a counteracting leverage aligned to resist the cantilever load presented by materials placed on the shelf. By the spacing of the pair of slots on two opposed sides of the column, rotation of a shelf in the frontal plane is resisted, as in the case of an unbalanced load being placed on the cantilever surface. The shelves may be inclined away from the column such that printed materials slide toward the column, and may be retained easily during movement.

As the stand is intended to have a small footprint, a small top is attached in the horizontal plane to rest small items, a single book, or beverage container. Such a utilitarian top is improved by the provision of a hand grip which allows a one-handed, balanced carrying position for moving the entire stand.

A column may be define only convex or exclusive surfaces in its cross-section, but interior surfaces may be provided to define enclosed space, as in the case of a "C" cross-section or channel. In the invention, the interior space of the "C" cross-section is employed for the variety of smaller objects that might be scattered in a living space, such as: pencils; various remote control video and audio devices; and the ubiquitous telephone. Since phones have acquired slimline profiles, they no longer need to occupy table top surface; also, dialing is often integral to the receiver mouthpiece unit. Such a phone may be mounted so as to be hidden in a recess but within easy reach. Within an enclosed channel there may be provided simple shelf partitions or slidable pockets and also a phone mount which may be slidable and "pop up" for use.

The collection of reading, entertainment, and communication objects that are common to a living space should be gathered in a moveable stand that may be maneuvered into proximity with a favored furniture such as an easy chair, or perhaps near to a desk or dining table. The invention provides an integrated configuration accomplishing this purpose. The advantages of the invention are made more specifically evident in the following drawings and description of the invention.

DRAWING FIGURES

| Drawing Reference List | |
|---|---|
| 2 channel column | 28 channel sliding pocket |
| 4 base | 30 liftable top piece |
| 6 side pieces | 32 retractable panel |
| 8 front piece | 33 optional hinged top piece |
| 9 enclosed channel space | 34 slot entry recess |
| 10 top | 36 stop |
| 12 strut | 37 panel lip |
| 14 handhold opening | 38 support pins |
| 16 shelf tray | 40 vertical hanging phone |
| 18 inclined slot | 42 hanger |
| 20 horizontal slot | 44 temporary phone rest |
| 22 inward slot | 46 spring pins in frontpiece |
| 24 channel partition | 48 spring pin in top piece |
| 26 inward vertical slot | 50 spring |

DESCRIPTION OF THE ILLUSTRATED EMBODIMENTS

Figure 1:
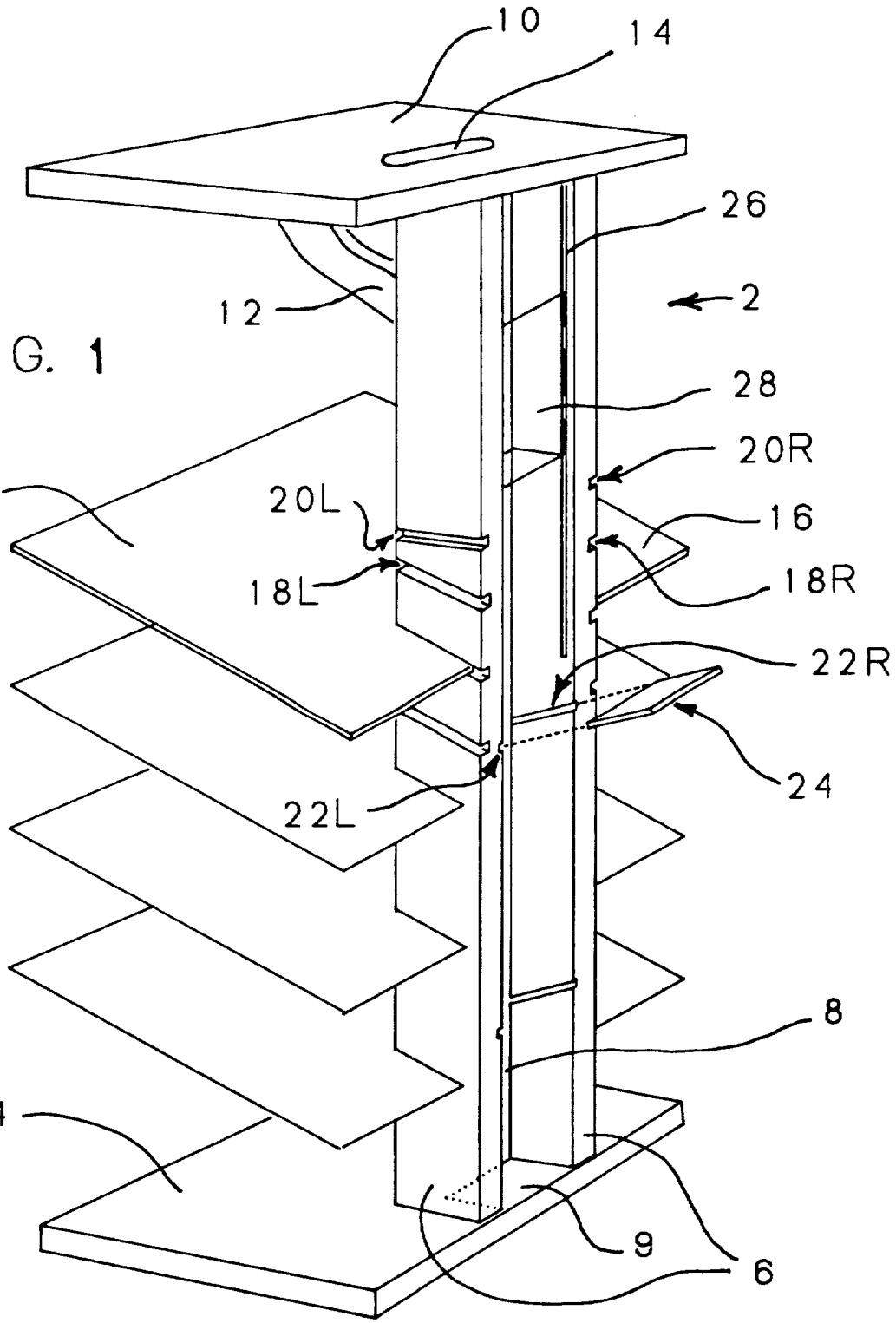
FIG. 1 shows a perspective drawing of the stand for reading materials as seen from from the rear and slightly above.

FIG. 1 shows a rear view perspective of the preferred embodiment of the invention. The rear view provides a view of the useable space of a "C" shaped or channel column 2 which creates the channel space 9, shown intersecting onto basepiece 4. The column consists of two side pieces, 6, joined longitudinally to a frontpiece 8, which is partially visible at the angle of perspective.

A top 10 and strut 12 combine to provide a rigid continuity with the column so that a handhold opening 14 may be used to lift the entire stand including its potentially weightly content of magazines or books. Although it may seem unusual to have a hole in any table top, even of small size attached to a stand, the handhold is placed in the center of balance of the entire stand, so that the user may lift the stand with one hand without shifting items on its shelves and carry it to a chosen location to accompany activities such as reading or deskwork. The one-handed lift allows a free hand for the carrying of other objects to the location, such as a cup of coffee, which may subsequently rest on the small by strategically placed top.

The column 2 provides paired slots on opposed faces of its sidepieces 6. It is preferred to provide multiple inclined slots 18L & 18R which may be chosen to receive a shelf tray 16 which bears papers, books, or magazines. The inclination causes the items carried on the shelf tray to shift toward the frontpiece 8 of the column 2. When carrying the stand in any direction of the compass, shifting of contents is diminished by orienting the front to back axis of the stand with the direction of travel. Multiple shelf trays identical to 16 may be provided to be placed in desired spacing from each other according to available multiple slots. As a contingency for versatility, a topmost pair of horizontal slots, 20L & 20R, are provided to allow a shelf-tray 16 to become auxilliary horizontal surface.

Although a solid column could provide the multiple slots for the mounting of shelves, as described above, a "C" shaped or channel column provides enclosed space which may house small articles. Pairs of inward slots 22L allow for the insertion of a channel partition 24; again, it is preferred that the slots 22 decline inward, toward the column 2. A channel sliding pocket 28 may be mounted in an inward vertical slot 26. Pocket 26 may contain pencils and may be constructed with a 90 degree fold of a single sheet of transparent polymer which is durable both to repeated sliding and spring tension. The vertical face of pocket 26 is sized to be loosely fitted within the vertical slots, and the bottom face of pocket 26 is sized to place a slight tension against the surface of frontpiece 8 of column 2, so that the pocket stays in place by friction fit.

A traditional vertical hanging phone may be mounted in the recessed channel space 9 formed by channel column 2; a preferred location would be mounting on the surface of frontpiece 8. Additionally a retractable panel can be employed in this enclosure space which may provide a moveable mount for a phone or a pocket container similar to pocket 26. Such a retractable panel requires an exit from channel space 9 through top 10, as shown in the following Figures.

Figure 2:
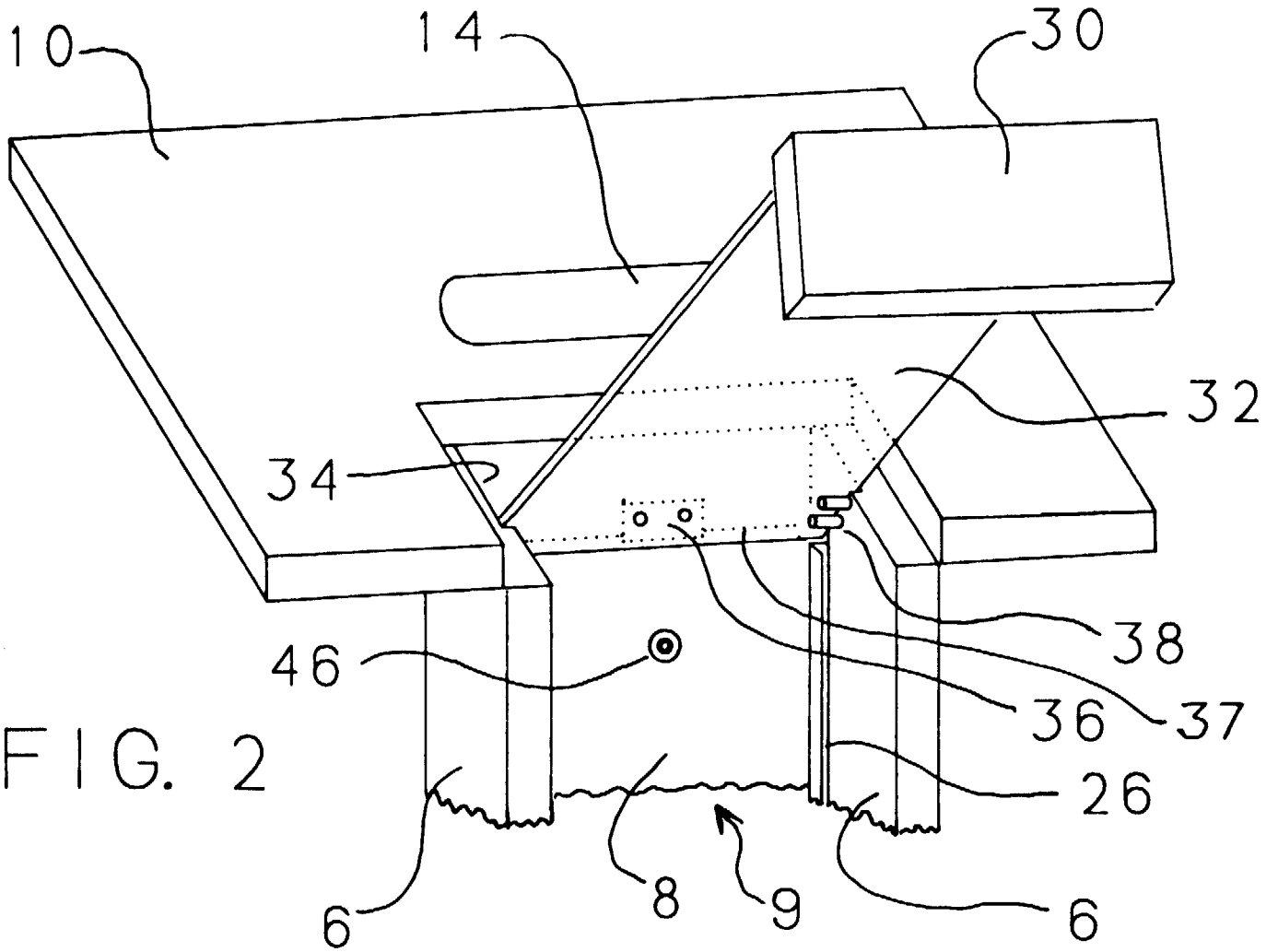
FIG. 2 shows a perspective drawing, from the rear and above, of a slideable panel which is opened outward and provides mounting surface for a phone.

FIG. 2 shows a retractable panel 32 joined to a liftable top piece 30 which is a portion separated from top 10. The slideable panel is fully opened such that a panel lip 37 engages a stop 36 as the panel exits the top of inward vertical slots 26, which are paired slots one of which is visible in the perspective view. In continuity with the paired vertical slots 26, and providing the same distance to accommodate the width of the retractable panel 32, there are a pair of slot entry recesses 34 which allow the panel to tilt as shown in FIG. 2 to remain standing. Optionally, support pins 38 may be added along the angled edge of slot entry recess 34.

As an additional feature, panel 32 can be held in an entirely vertical position within inward vertical slots 26 by the engagement of panel lip 37 on spring pin 46 which also may be known as a "bullet catch". this spring pin may be mounted in the surface of frontpiece 8 such that its pin protrudes to engage the lip as does the stop 36, although the lip may be forced past the spring pin to continue panel sliding along slot 26.

Figure 3:
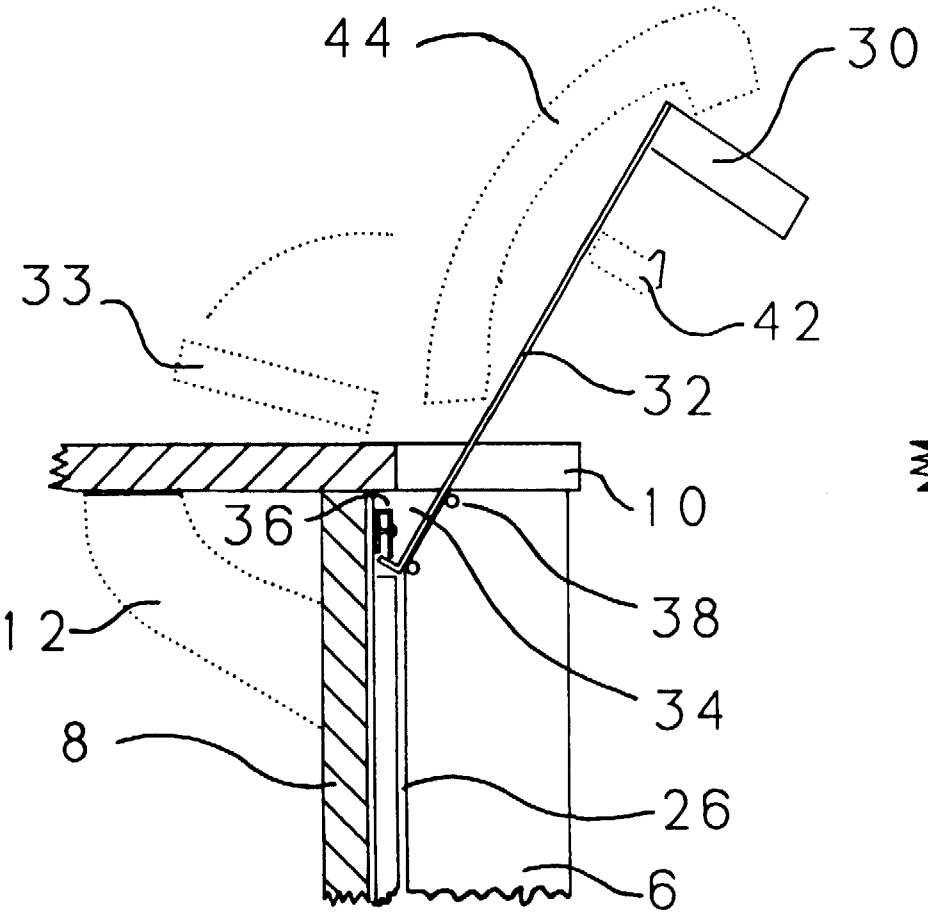

FIG. 3 shows a side view of panel 32 fully opened and leaning within the slot entry recess 34 and engaged by stop 36. Phone position 44 demonstrates that some slim line phones may be temporarily hung up on any corner such as offered by the intersect of panel 32 and liftable top-piece 30. Also, many hanging phones are retainable on a hanger such as 42 even when tilted in the upside-down direction from vertical. Optional top-piece 33, which is a hinged separation from top 10, illustrates the disadvantage of such hinging, which occupys valuable top surface as well as depriving the user of a graspable, liftable piece 30.

Figure 4:
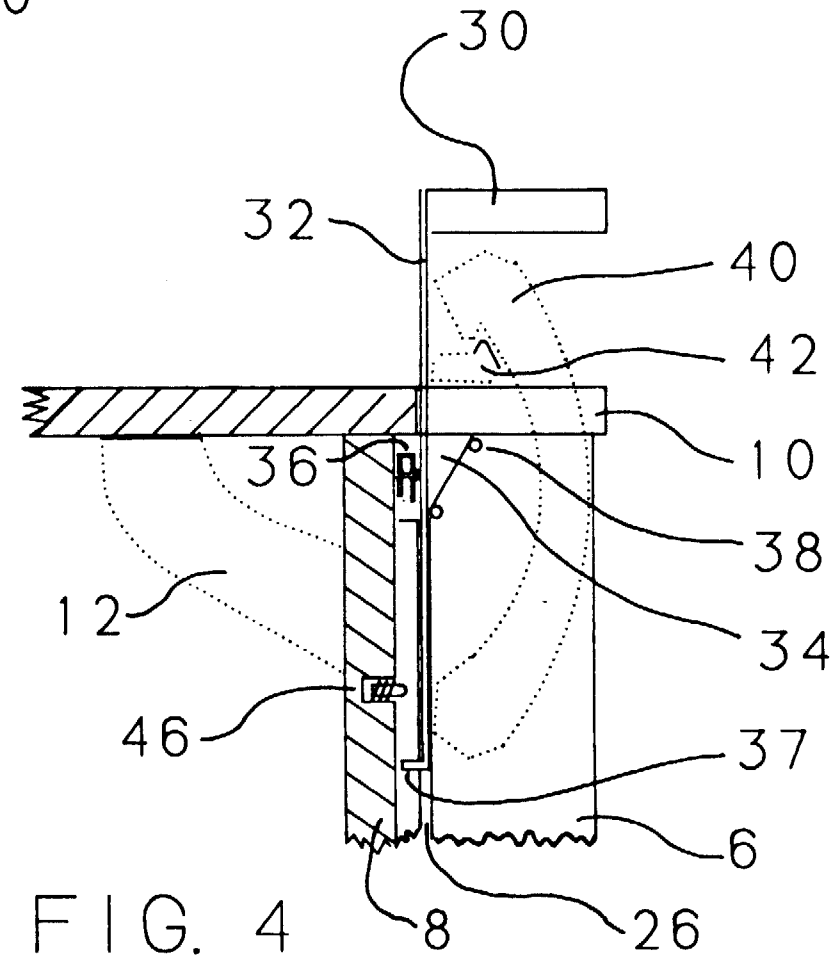
FIG. 3 and FIG. 4 show side views of two positions of a retractable panel utilized within the column support of the invention.

FIG. 4 shows a typical vertical hanging phone 40 and hanger 42 mounted on partially retracted panel 32. It can be seen that panel lip 37 is aligned with the surface of frontpiece 8 during the travel of panel 32 along inward vertical slot 26, so that it may engage a protruding spring pin mounted anywhere along the surface of front piece 8.

Figure 5:
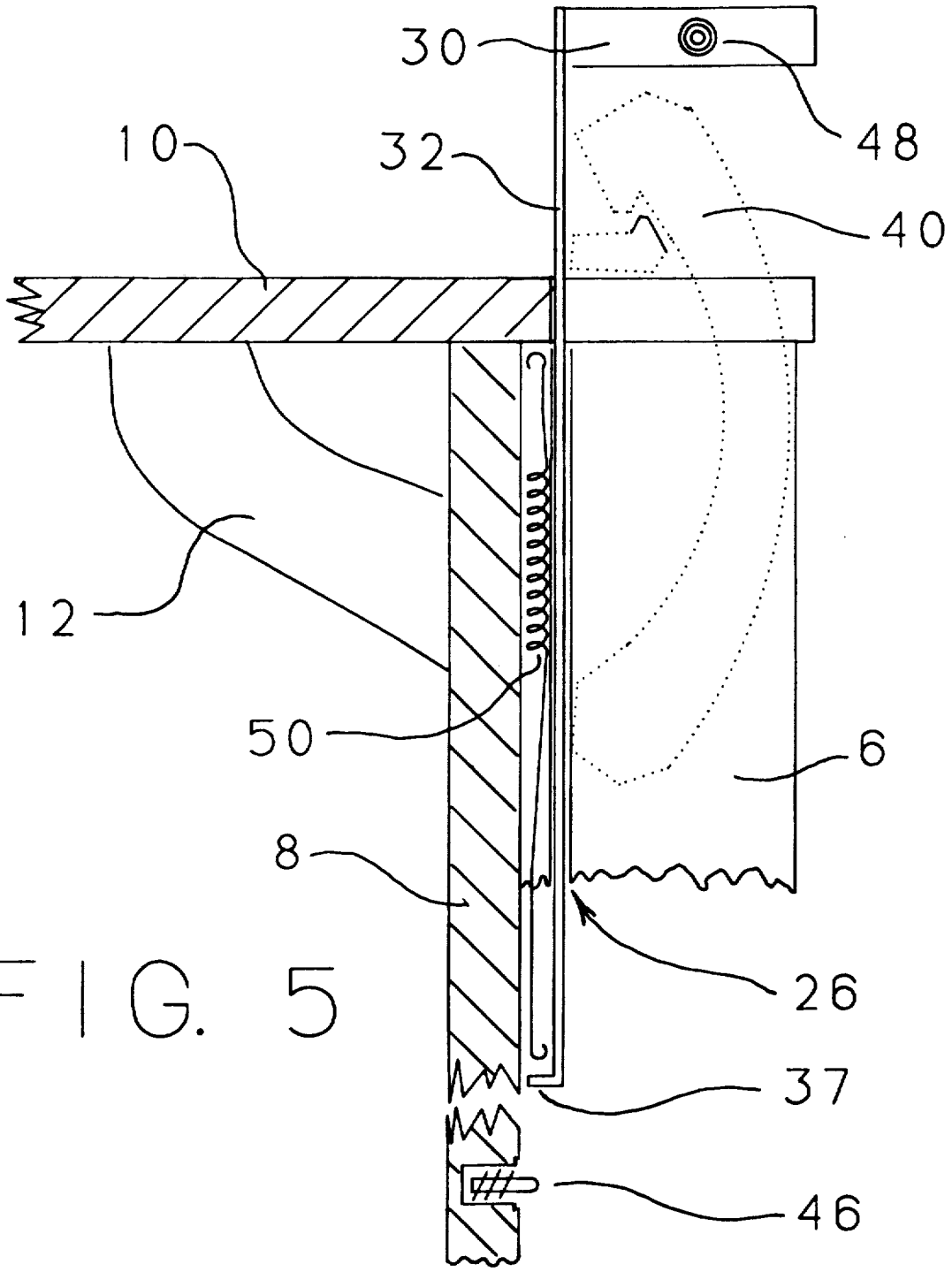
FIG. 5 shows a side view of a slideable panel and spring attachment.

FIG. 5 shows a phone 40 mounted on a slideable panel 32 moveable within slot 26 with the addition of a spring 50, which causes the panel to "pop up" vertically. Such a spring 50 is shown schematically and may be attached anywhere at the top of frontpiece 8 of the column or to the overhanging portion of top 10 and also inserted on the lower end of panel 32, near to the panel lip 37. Panel 32 must extend below the phone 44 by a distance generally equalling the retracted length of spring 50, and the travel of the spring 50 should allow for movement equal to the full length of phone 40.

In the down position, retractable panel 32 is under tension and requires a releasable catch such as spring pin 46 engaging panel lip 37 at its downward most position. Alternate sites of spring pins may be in top piece 30, such as spring pin 48, which which must engage a strike plate in the cutout of top 10.

In this invention of a stand for reading material, phone, and other items, the single column provides two orientations of slots for the mounting of shelves, partitions, or panels. In external orientation, paired slots may receive the cutout edges of shelf-trays; and, in inward orientation, paired slots within the channel provide for partition shelves or vertical slots allow for retractable panel mounting.

For the mounting of shelf-trays on two sides of a single column, paired slots may be placed on the same, two opposed surfaces of the column. Since it is preferred that shelf-trays decline toward the column, the two "banks" of shelf trays would require slots with opposed angles of inclination which may be placed in either alternating or intersecting ("X") spacing on a common side of the column. However, the "channel" column offers a preferred complimentary space (enclosed or inward) which may contain a variety of small objects unlike magazines. Pencils and phone are a few of such items that are found in living spaces. The utilization of "inward" oriented slots within this channel space allows for unique partitions, and moveable pockets or panels to be provided.

In decorative terms, the channel column provides a hidden space for many small objects that are objectionable to decor, but need to be within easy reach. For decorative choice, the opposed faces of the sidepieces 6 of the channel column need not be parallel planes, though the pieces should have parallel logitudinal axes in conjunction with frontpiece 8. For example, the cutout from shelf-tray 16 may be a half-hexagon, in which case, the shelf-tray could be configured to fit paired slots in only one inclination only (e.g. not both horizontal and inclined).

The varying adjustable geometry afforded by this invention of a stand makes it an accessory freed from the concept of static form presented in much furniture. It can be understood that many preferred embodiments can follow from the features presented. The scope of the invention is further conveyed in the claims.

I claim:

1. A stand for supporting generally planar printed materials and also diverse shaped and not-flat objects comprising:

a channeled column with means to stand substantially vertically, including an attached planar base piece, said channeled column having a generally C shaped cross section whereby two longitudinal opposing portions are held generally parallel to each other and are joined by a central joining portion;

a cantilevered planar shelf having a cutout along one of its edges, said channeled column to receive said cutout in an orientation whereby said planar shelf is directed onto said channeled column at said joining portion which is at the convex aspect of said C cross section;

means to engage said cutout at a location upon said channeled column including whereby said two opposing portions each have an outward oriented surface carrying a groove forming a pair of outward grooves, and said cutout has two generally parallel edges matched to be received onto said pair of outward grooves;

said channeled column retaining a useable channel space within inward oriented surfaces wherein the attachment of said cantilevered planar shelf at any position along said convex aspect does not intrude on, or obstruct access, to the concavity of said useable channel space.

2. A stand as claimed in claim 1 wherein said channeled column contains multiple pairs of said outward grooves along each said outward oriented surface for the mounting of multiple cantilevered planar shelfs and the selectable positioning of any individual shelf at varying angles and altitudes according to the orientation and location of any of said multiple pairs of grooves.

3. A stand as claimed in claim 1 wherein a top is attached to the top of said channeled column and including a handhold opening in said top.

4. A stand as claimed in claim 1, wherein at least one channel planar piece having at least two substantially opposed parallel edges, including a simple rectanglular shape, is received into the concavity of said channel space between said two opposing portions, bearing means to engage said opposed parallel edges at a chosen location on inward oriented surfaces which are provided and formed by said opposing portions, including a groove cut into each inward oriented surface to form a pair of inward grooves substantially parallel with each other and defining a distance matched to receive a fitted said channel planar piece.

5. A stand as claimed in claim 4, wherein said pairs of inward grooves are oriented at acute angles to the longitudinal axis of said channeled column such that said fitted channel planar piece defines a shelf-like partition of said channel space.

6. A stand as claimed in claim 4, wherein a pair of said inward grooves are oriented generally vertically and a slideable panel is provided that may be carried in the path defined by said vertically oriented grooves.

7. A stand as claimed in claim 6, wherein said vertically oriented slideable panel is a retractable panel from said channel space wherein the top of said channeled column is opened for upward exit of said slideable panel.

8. A stand as claimed in claim 7, providing for positioning and retention of said slideable panel within said channel space wherein a catch is mounted on an inner surface of said channel space of said channeled column, said catch engaging and impinging on said slideable panel to hold it at a position within said channel space of said channeled column, said catch including but not limited to a spring loaded protrusion such as a spring pin.

9. A stand as claimed in claim 9, providing "pop up" of said retractable panel from said channel space wherein a spring is provided and positioned such that the upper end of said spring attaches at an upper region of said channel space and the lower end of said spring attaches at a lower region of said retractable panel which slides within said vertically oriented paired grooves.

10. A stand as claimed in claim 7, providing for stable and tilted standing of said retractable panel wherein said retractable panel at is upper most travel may exit said vertically oriented paired grooves into recessed entry spaces which are provided contiguous with said vertically oriented paired grooves and cut into same said inward oriented surface, said recessed entry space providing for tilt of said panel which is positioned outside of said paired vertical grooves and a stop is mounted on an inner surface of said channel space where it may impinge upon said folded lip of said retractable panel to retain said panel within said recessed entry space.

11. A stand for attachment of shelves or panels for the carrying of both flat materials and other objects comprising:

a channeled column with generally vertical orientation having inward oriented surfaces defining channel space and outward oriented surfaces, one or more first panel pieces each having on one edge a cutout sized to engage said outward oriented surfaces such that said first panel is held in attachment to said channeled column, said outward oriented surfaces having paired grooves cut to dimensions matched to the dimensions of said cutout such that a pair of grooves defines and provides a neck to receive said cutout which generally defines a yoke, inward grooves provided in pairs which are generally parallel and provided such that each groove of a pair is on an opposing face of said inward oriented surfaces, and one or more channel panel pieces sized to match the dimension of and movable within the dimension provided by a pair of said inward grooves.

* * * * *